US006047442A

United States Patent [19]

Workman

[11] Patent Number: 6,047,442

[45] Date of Patent: Apr. 11, 2000

[54] RELEASABLE LOCK MECHANISM FOR LUGGAGE TOWING HANDLE

[75] Inventor: David E. Workman, Princeton, N.J.

[73] Assignee: Tumi, Inc., South Plainfield, N.J.

[21] Appl. No.: 09/033,876

[22] Filed: Mar. 3, 1998

[51] Int. Cl.[7] ..... E05B 7/00

[52] U.S. Cl. ..... 16/113.1; 280/651; 280/47.315

[58] Field of Search ..... 16/113.1; 280/651, 280/651.1, 47.315; 190/18 A, 115

[56] References Cited

U.S. PATENT DOCUMENTS

| | | | |
|---|---|---|---|
| 3,606,372 | 9/1971 | Browning . | |
| 4,974,871 | 12/1990 | Mao | 280/651 |
| 5,295,565 | 3/1994 | Latshaw . | |
| 5,414,895 | 5/1995 | Kazmark, Jr. | 16/113.1 |
| 5,438,731 | 8/1995 | Kazmark, Jr. | 16/113.1 |
| 5,499,426 | 3/1996 | Hsieh . | |
| 5,515,576 | 5/1996 | Tsai . | |
| 5,526,908 | 6/1996 | Wang . | |
| 5,630,521 | 5/1997 | Waddell et al. . | |
| 5,810,132 | 9/1998 | Chang | 16/113.1 |
| 5,816,374 | 10/1998 | Hsien | 16/113.1 |

*Primary Examiner*—Chuck Y. Mah
*Attorney, Agent, or Firm*—Baker & Botts L.L.P.

[57] ABSTRACT

A releasable lock mechanism includes a base having guideways that carry a pair of lock rods for lateral movement along a drive axis in opposite directions with respect to each other between outward, locking positions in which noses on the distal ends of the lock rods are received in holes in each of the two legs of a U-shaped towing handle and inward, release positions, in which the noses are withdrawn from the holes so that the handle can be moved. A push-button driver plate moves along the base perpendicular to the drive axis and pushes the lock rods in and out along drive axis by cam slots on the driver plate that work against cam posts on the lock rods. A compression spring biases the driver plate to an upward position, in which the lock rods are engaged in, or are biased outwardly in readiness to be engaged in, the holes in the towing handle.

20 Claims, 5 Drawing Sheets

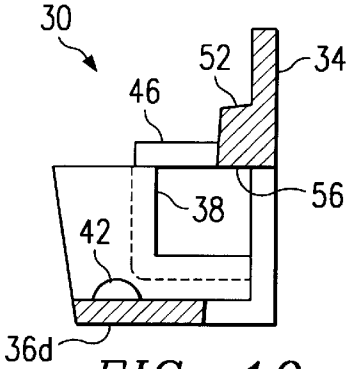
FIG. 10
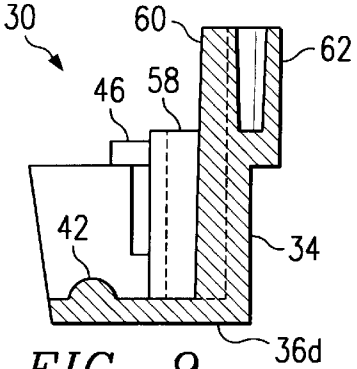
FIG. 9
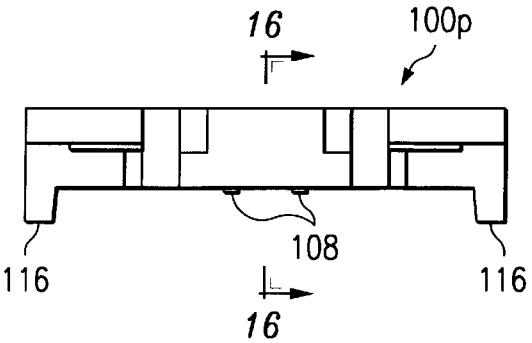
FIG. 14
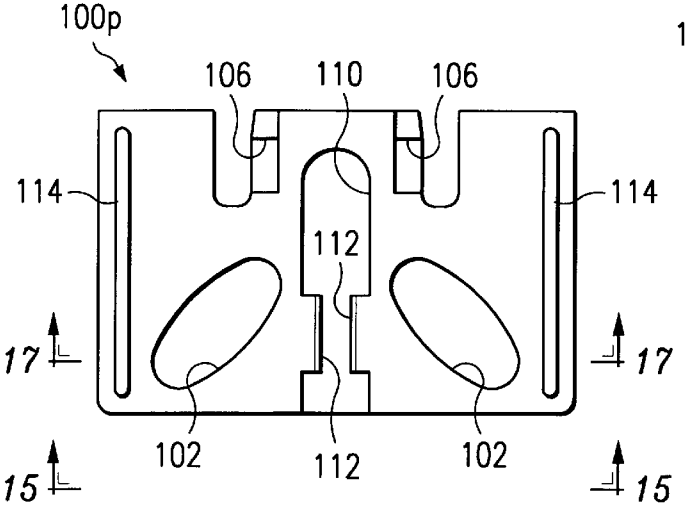
FIG. 12
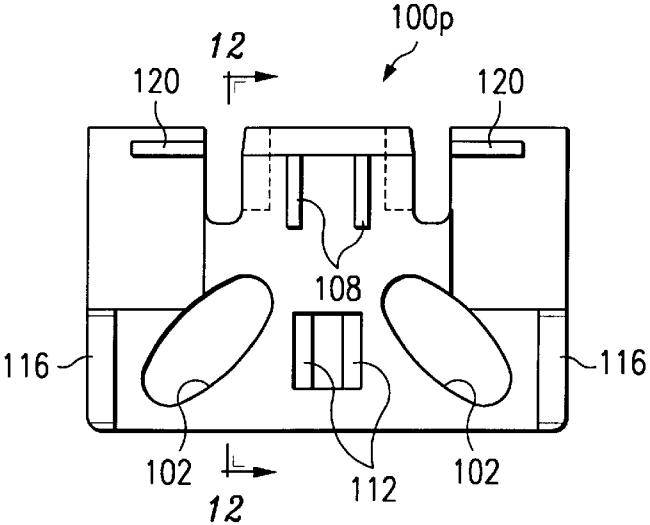
FIG. 11
FIG. 13

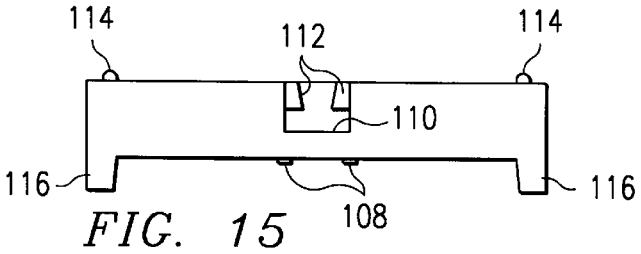
FIG. 15
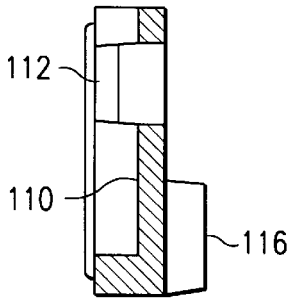
FIG. 16
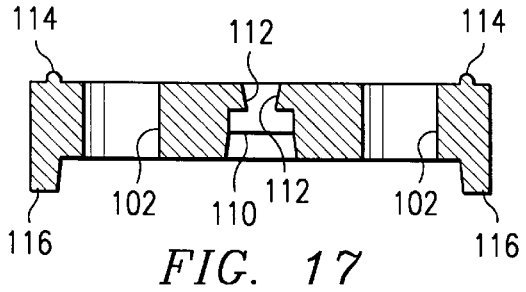
FIG. 17
FIG. 20
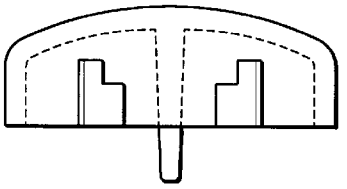
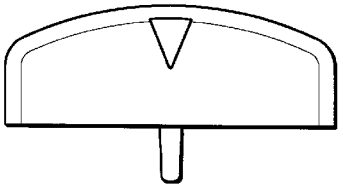
FIG. 18
FIG. 21
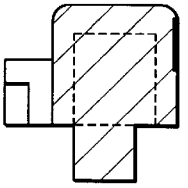
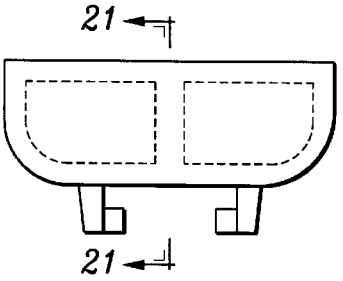
FIG. 19
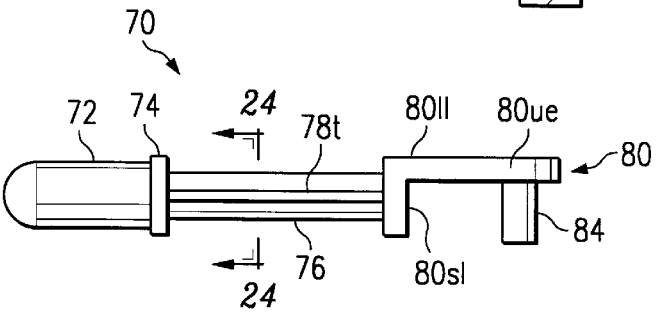
FIG. 22
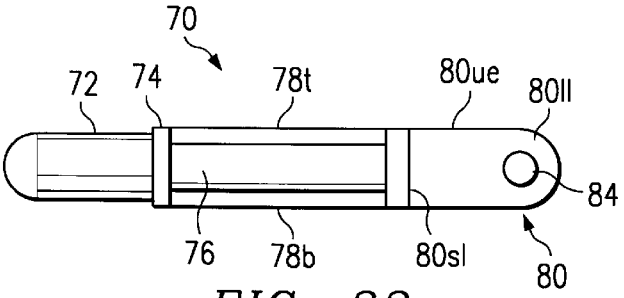
FIG. 23
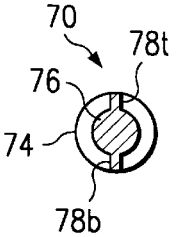
FIG. 24

RELEASABLE LOCK MECHANISM FOR LUGGAGE TOWING HANDLE

TECHNICAL FIELD OF THE INVENTION

The present invention relates generally to wheeled luggage and, more particularly, to a releasable lock mechanism for locking the towing handle of an item of wheeled luggage in a retracted position for storage and transport and in an extended position for wheeling the luggage from place to place.

BACKGROUND OF THE INVENTION

Within about the past five years, wheeled luggage of the type having a box-like body, a pair of wheels adjacent the sides of the lower edge of the back wall of the body, and a towing handle that pulls out from adjacent the top edge of the back wall have become immensely popular. Most wheeled luggage of that type has a U-shaped towing handle, the legs of which telescope into tubular sheathes that are located within the bag along the back wall panel of a hard box-like casing that forms five of the six sides of the luggage body.

It is well-known to have a releasable lock mechanism associated with the two legs of the towing handle for locking the handle in the stowed position within the sheaths and the towing position in which the handle extends from the bag body. Among the previously known lock mechanisms are some that include spring-loaded lock rods that move in opposite directions along an axis transverse to the legs of the towing handle in and out of holes in the legs and an actuator having sloping face cams, each of which engages a sloping cam follower surface on the corresponding lock rod. Examples of previously known locking mechanism for the towing handles of wheeled luggage of the type to which the present invention relates are found in U.S. Pat. Nos. 5,499,426 (Hsich, 1996), 5,515,576 (Tsai, 1996), and 5,526,908 (Wang, 1996).

The previously known lock mechanisms are of relatively complicated construction, the designs including, with case-by-case variations, a separate spring for each lock rod, screws or bolts and nuts for assembly, and large push buttons with large spacings between the operating cams. The complicated construction and intricate assembly result in high manufacturing costs. The operating cams have planar surfaces oblique to the axis of movement of the rods and act on follower surfaces on the rods that are eccentric to the axis along which the lock rods move. The flat surfaces are subject to high friction, particularly static friction that acts when the push buttons are first depressed. The large spacing between the cam surfaces can produce large moments on the driver bar of the push button due to differences in the forces opposing movements of the lock rods, which can lead to binding and sticking. At the very least, previously known lock mechanisms for luggage towing handles are subject to various load conditions due to high friction at the cam surfaces and at surfaces that support and guide the lock rods, large moments arms, eccentric forces, separate springs, and other design details, all of which combine to impair smooth and reliable operation.

SUMMARY OF THE INVENTION

One object of the present invention is to provide a releasable lock mechanism for a towing handle of an item of wheeled luggage that operates smoothly and reliably. Another object is to provide a lock mechanism that is configured to minimize friction forces between components that move relative to one another. It is also an object to provide a lock mechanism in which side loads on the locking rods are minimized when the mechanism is actuated from an at-rest position, in which static friction forces must be overcome. It is also desired to provide a lock mechanism that can be manufactured at low cost and that can be assembled quickly and easily.

The foregoing objects are attained, in accordance with the present invention, by a releasable lock mechanism for a luggage towing handle that is movable relative to a bag body between an extended position and a retracted position, the towing handle having a pair of spaced-apart parallel straight legs. The lock mechanism has a base that is adapted to be affixed to the bag body in a position between the legs of the handle. The base includes a pair of guideways defining a slide axis that is perpendicular to and intersects the legs of the towing handle. A lock rod is received in each of the guideways for sliding movement along the slide axis between a locked position in which a nose on a distal end of the lock rod is extended out from the base for reception in a hole in the leg and a release position in which the nose is retracted from the hole in the leg. Each lock rod has a cam follower post adjacent a proximal end. A push-button driver plate carried on the base for movement perpendicular to the drive axis actuates the rods by way of a pair of elongated cam slots, each of which receives the cam follower post of one of the lock rods and has a longer axis lying obliquely to the slide axis. A compression spring engaged between the base and the driver plate biases the driver plate to a position in which the cam slots hold the lock rods in the locked positions.

When the driver plate is pressed and moved against the bias of the spring, the cam slots work against the cam follower posts on the lock rods and retract the lock rods to the release position, thereby permitting the towing handle to be moved from the stowed to the extended position or vice versa. When the push button is released, the spring bias moves the driver plate in a direction to restore the lock rods to the latched position so that when the handle reaches the new position, the noses of the lock rods snap into the holes.

In previously known lock mechanisms, each lock rod is often individually biased by a separate spring. Accordingly, movements of the lock rods from the locked positions to the unlocked positions require that both the spring forces and the friction forces acting between the lock rods and the components that they engage be overcome in order for the lock pins to retract from the holes in the lags of the towing handle. In the lock mechanism of the present invention, the lock rods are freely movable, apart from the friction forces imposed on them, when the driver plate is depressed to retract the lock pins. The elimination of the spring forces at the cam/cam follower interfaces contributes to smoother, freer operation of the lock mechanism in the unlocking mode. In that regard, the cams exert both axial and lateral forces on the lock rods, the lateral forces usually being the major cause of friction between the lock rods and the guides that support them. Eliminating the individual spring for each lock rod reduces the force required to be overcome to move the lock rod from the locked position, not only by eliminating the spring force but by also reducing the friction force resulting from the lateral component of the force transmitted at the cam/cam follower interface.

It is advantageous and preferred that each of the cam slots in the driver plate be is substantially elliptical. At the extreme positions (fully extended or fully retracted) of the lock rods, the elliptical cam surfaces act with a higher ratio of axial to lateral forces on the follower posts than a comparable planar cam with the same operating stroke and output stroke. The extreme positions exist in the at-rest state of the mechanism, when static friction forces prevail. The high ratio of axial-to-lateral cam forces contributes to smoother operation by reducing side loads on the lock rods, relative to axial loads, in the at-rest, static friction condition. Static friction forces due to side loads are reduced, and static friction forces from other sources are overcome by greater axial forces exerted by the elliptical cam slots. It is also helpful to have the cam slots—and hence inherently the cam posts—positioned to be intersected by the slide axis. The cam/cam follower forces act along the slide axis. Another source of side loads on the lock rods is eliminated.

Another aspect of a lock mechanism, according to the present invention, is configuring the components with special attention to minimizing sources of friction between the base and the lock rods and the base and the drive plate, thus further ensuring smooth, easy operation of the mechanism and reducing the chance of malfunction or failure. Not all of the features described below are essential, but each contributes to better performance and greater reliability, durability, and long life of the mechanism. Preferred embodiments of the invention are, in furtherance of the foregoing, characterized by:

1) The cam follower posts have circular cylindrical surfaces, which engage the cam slots smoothly and with low friction.
2) Each of the guideways in the base is channel-shaped and includes a bottom wall, and each lock rod has a longitudinal bottom rib in sliding engagement with the bottom wall.
3) Each guideway of the base has a top guide bridge and each lock rod has a longitudinal top rib in sliding engagement with the top guide bridge.
4) Each lock rod has an offset leg portion, the cam follower post extends from the offset leg portion, and the back wall of the base has a projecting guide rib in sliding engagement with an upper edge of the offset leg portion of each lock rod.
5) The driver plate has a slide rib in engagement with a front face of the offset leg portion.
6) Each lock rod has a peripheral guide rib adjacent the nose that is in sliding engagement with a bottom wall, a front wall, and a back wall of the guideway of the base.

One way of supporting the driver plate, in a preferred arrangement, is by providing a driver plate guide rib on the back wall of the base and a groove on the back of the driver plate that receives the guide rib for sliding movement. Assembly of the mechanism is facilitated by joining the driver plate guide rib and the driver plate groove by a snap-fit coupling.

BRIEF DESCRIPTION OF THE DRAWINGS

For a more complete understanding of the present invention and additional preferred features, and the advantages thereof, reference may be made to the following written description of an exemplary embodiment, taken in conjunction with the accompanying drawings, in which:

FIGS. 5 to 10 are views of the base, as follows:

Figure 1:
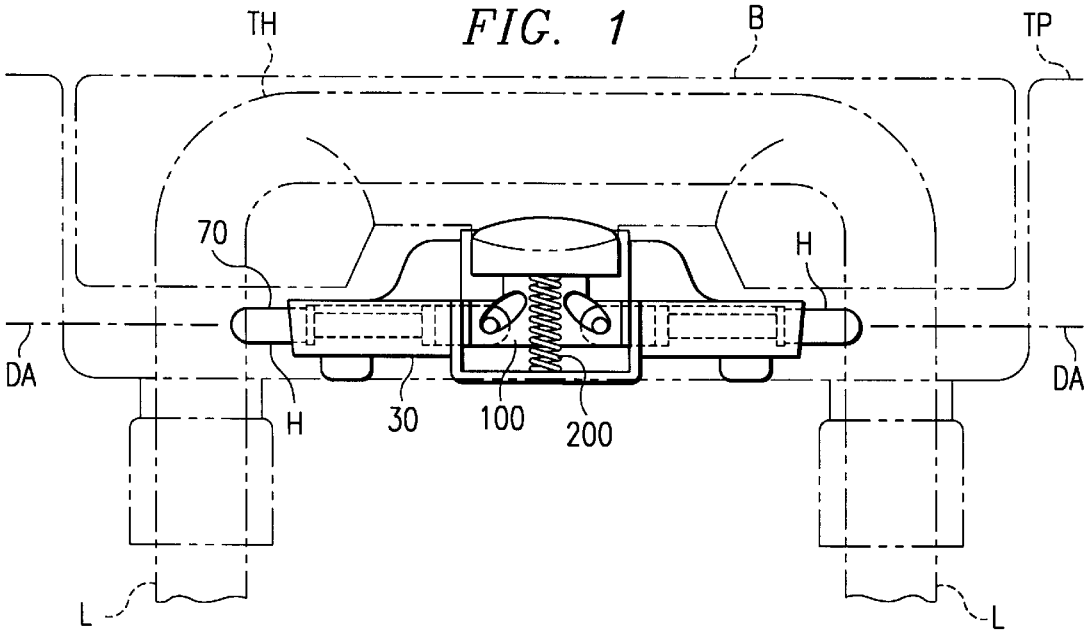
FIG. 1 is a front elevational view of the embodiment, showing it with the lock rods extended and portions broken away.
Figure 2:
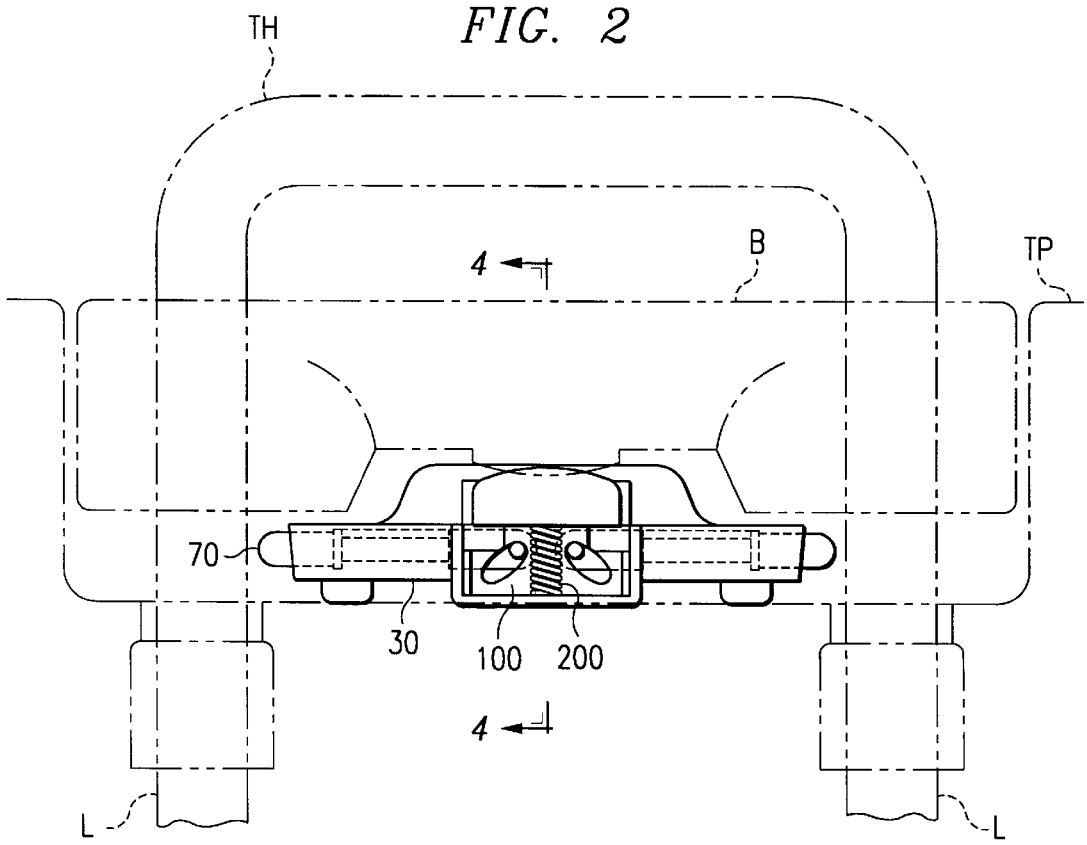
FIG. 2 is a front elevational view of the embodiment, showing it with the lock rods retracted, portions also being broken away.
Figure 3:
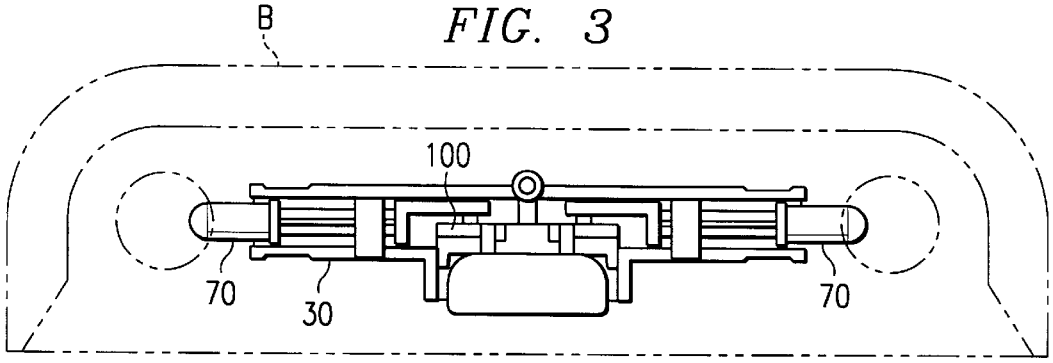
FIG. 3 is a top plan view of the embodiment.
Figure 4:
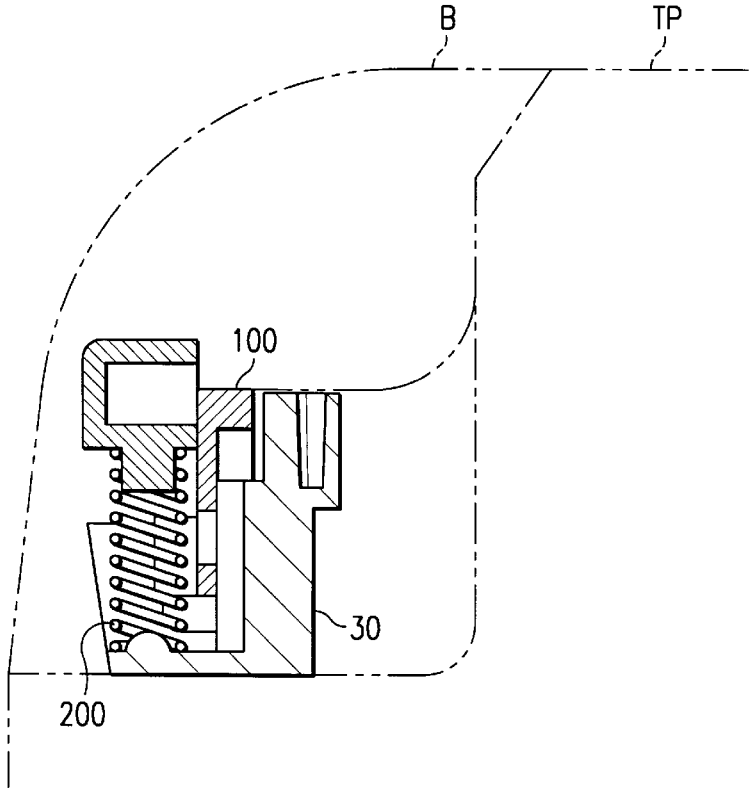
FIG. 4 is an end cross-sectional view, taken along the lines 4—4 0f FIG. 2.
Figure 5:
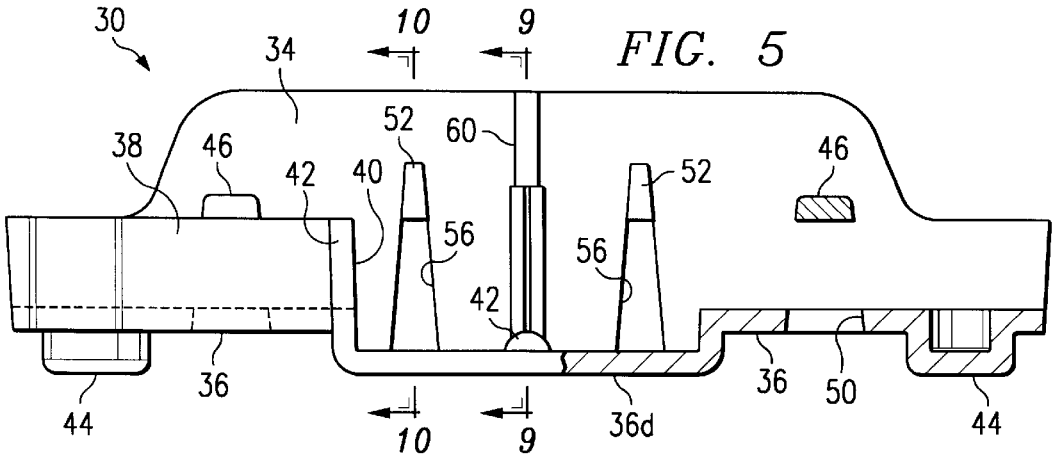
Figure 6:
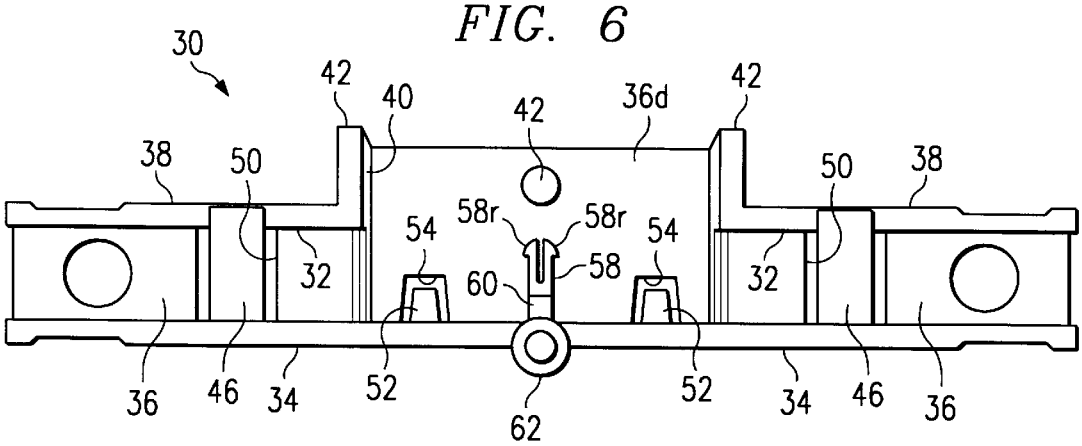
Figure 7:
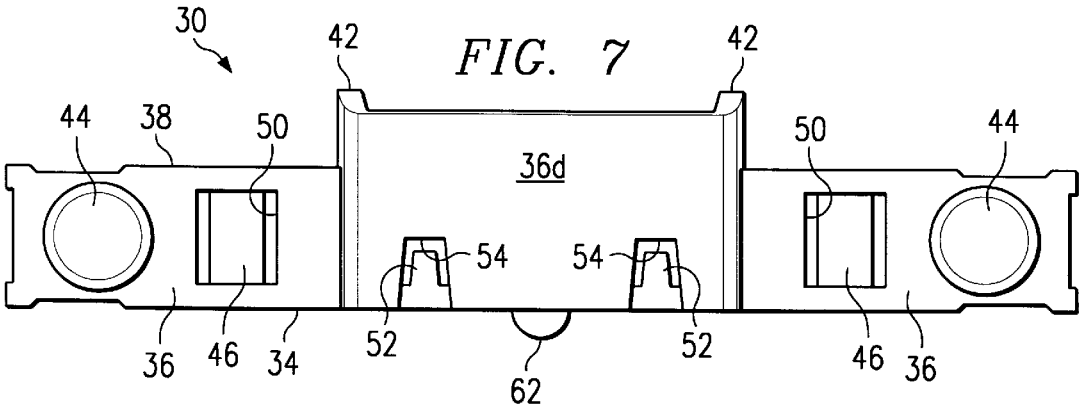
Figure 8:
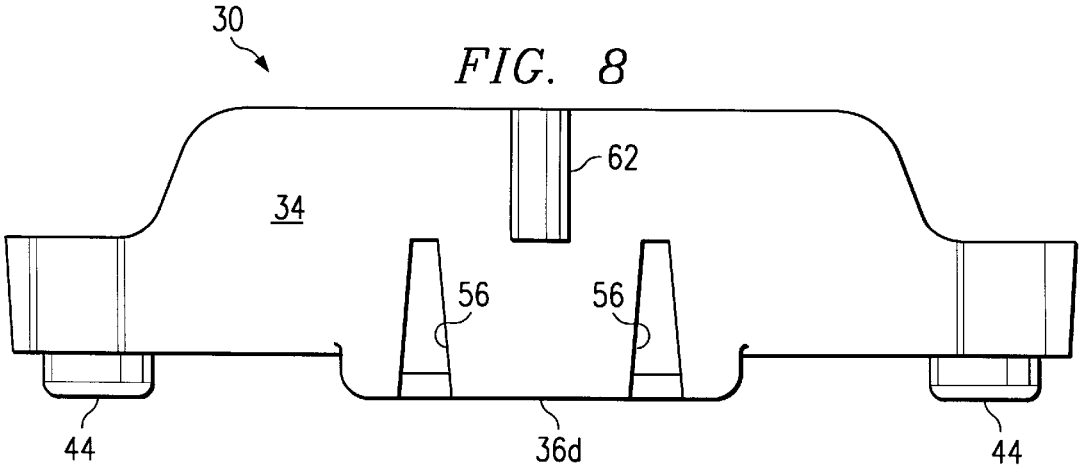

5—front elevational, portions broken away;

6—top plan;

7—bottom plan;

8—rear elevational;

9—end cross-sectional, at 9—9 of FIG. 5

10—end cross-sectional, at 10—10 of FIG. 5;

FIGS. 11 to 17 are view of the driver plate, as follows:

11—front elevational;

12—broken cross-sectional at 12—12 of 11;

13—rear elevational;

14—top plan;

15—bottom plan;

16—cross-sectional at 16—16 of 14;

17—cross-sectional at 17—17 of 13; and

FIGS. 18 to 21 are views of the push button, as follows:

18—front elevational;

19—top plan;

20—rear elevational;

21—cross-sectional at 21—21 of 18; and

FIGS. 22 to 24 are views of the lock rod, as follows:

22—top plan;

23—front elevational;

24—cross-sectional at 24—24 of 22.

DESCRIPTION OF THE EMBODIMENTS

An exemplary embodiment of the present invention and its advantages are best understood by referring to FIGS. 1 to 24 of the drawings, like numerals being used for like and corresponding parts of the various FIGURES. The teachings of the present specification may be used to advantage in lock mechanisms of various specific configurations.

The embodiment includes a base 30 having guideways 32 on the sides, each of which receives a lock rod 70 for lateral movement along a drive axis DA. The lock rods move in opposite directions with respect to each other between outward, locking positions, in which noses 72 on the distal ends of the lock rods are received in holes H in the two legs L of a U-shaped towing handle TH, and inward, releasing positions, in which the noses are withdrawn from the holes H so that the handle can be moved. Each leg L of the towing handle TH has two holes, one near the upper end for the collapsed position of the handle and one near the lower end for the extended position of the handle. A push-button driver plate 100 is coupled to the lock rods 70 and moves them in and out along a drive axis DA on the base by cam slots 102 on the driver plate that engage cam posts 84 on the lock rods. A compression spring 200 biases the driver plate 100 to an upward position, in which the lock rods 70 are engaged in, or are biased outwardly in readiness to be engaged in, the holes H in the towing handle.

Except for the spring 200, all of the components are, preferably, made by injection molding in two-part molds from rigid, durable polymeric materials, a process that accounts for certain specific features, some of which are mentioned below. Injection-molding offers economies in mass production and permits minimizing the number of parts by facilitating the inclusion of several complex elements in each part that enhance the functional characteristics of the mechanism.

The base 30 (FIGS. 5 to 10) has a rear wall 34, a bottom wall 36 and a pair of front walls 38, a gap 40 being left at the front of the base to facilitate access for the installation of the spring 200, the lower end of which is accepted on a spring retainer boss 42 on a bottom wall depression 36*d*. Side flanges 42 project from the front walls 38 on either side of the gap 40. Dependent bosses 44 on the underside of the bottom wall 36 near the distal ends of the base (close to the legs L of the towing handle TH) rest on the bottom wall of a cavity in the top pan TP of the luggage and transfer downward loads on the bottom wall 36 from the base to the cavity. The U-shaped side portions of the base—portions generally distally of the the front flanges 42—form the guideways 32 for the lock rods. Each guideway has a top guide bridge 46, which is formed by raised tapered (for mold release) bosses on the lower mold part (not shown), thereby leaving rectangular holes 50 in the bottom wall 36. Guide ribs 52 project frontally from the rear wall proximally of the inner ends of the guideways—hence the holes 54 and 56 left by mold bosses. A drive plate guide rib 58 extends out from the front surface of the back wall 34 and vertically upwardly from the bottom wall depression 36*d* partway toward the upper edge of the back wall. The guide rib 34 is bifurcated axially and has male snap-fit ribs 58*r* at the tip of each leg portion. A slide rib 60 continues upwardly from the upper end of the guide rib 58. A boss 62 in the upper center of the back side of the back wall receives a locating pin (not shown) on the bezel B (see FIGS. 1 to 4) that is received in the cavity of the top pan TP and covers the lock mechanism.

The two lock rods 70 are identical. Each has (see FIGS. 22 to 24) a nose 72 at the distal end, which as described above is received on a hole H in the leg L of the towing handle TH. A peripheral flange 74 adjacent the nose 72*is* in a sliding fit with the rear, bottom and front walls 34, 36, 38 of the guideway 32 in the base. A shank 76 is in clearance from the walls of the guideway but has a bottom rib 78*b* that slides on the bottom wall and a top rib 78*t* that slides on the undersurface of the bridge 46. A shorter leg 80*sl* of an L-shaped flange 80 spans the space between the front and back walls 34, 38 of the guideway 32 with a fairly large clearance, say 1 mm, but provides front to back guidance for the proximal portion of the lock rod in the guideway. A longer leg 80*ll* is offset to the rear of the slide axis and carries the circular cylindrical cam follower id post 84. The upper edge 80*ue* of the flange 80*ll* is in sliding fit with the undersurface of the guide rib 52. Thus, guidance of the lock rod 70 along the slide axis of the base consists of:

- on the bottom, the flange 74 and the bottom rib 78*b* slide on the bottom wall 36 of the guideway;
- on the top, the top rib 78*t* slides on the undersurface of the bridge 46, and the edge 80*ue* slides on the undersurface of the guide rib 52;
- at the front, the flange 74 and the front edge of the leg 80*sl* slides on the front wall 38; and
- at the back, the flange 74 and the back face of the leg 80*ll* slide on the back wall 34.

All of the surfaces of the lock rod 70 that are in sliding relationship with surfaces of the base 30 are of relatively small areas, and all clearances are relatively large, thus affording a fairly high degree of laxity in the movement of the lock rod radially with respect to the slide axis in all directions.

The push-button drive plate 100 is made in two parts, the plate 100P (FIGS. 11 to 17) and the push button 100B (FIGS. 18 to 21), in order to provide each part with openings and cavities that are mutually perpendicular while permitting the use of relatively simple two-part molds. The parts are joined by reception in a press-fit and snap-fit relation of a pair of L-shaped (in top plan) coupling flanges 140 on the push button 100B in L-shaped notches 104 in the plate 100P. The configurations of the coupling flanges and the notches can be understood from the drawings. Note that the shoulders 142 on the inturned end legs of the coupling flanges 140 snap under the snap-fit shoulders 106 of the notches 104. Ribs 108 on the front face of the plate 100P facilitate sliding of the parts together while maintaining an interference fit front to back.

A vertical guide groove 110 (FIG. 13) extends from the lower edge of the plate 100P and is received with a snap fit, provided by snap-fit shoulders 112 along part of its vertical extent, on the guide rib 58 of the base 30. Vertical slide ribs 114 near each side edge of the back face (FIG. 13) bear against the front faces of the legs 80*ll* of the lock rods, thus to minimize friction between the drive plate and the legs 80*ll* of the lock rods for smoother operation of the lock mechanism. Side guide flanges 116 extend forwardly from the lower side portions of the plate and are in loose sliding fits with the flanges 42 of the base 30. The bezel B that covers the compartment in which the lock mechanism is installed (mentioned above) has an opening for the push button 100B. A dependent flange (not shown)that extends part way around the button opening guides the push-button drive plate 100. Friction is minimized by having the upper part of the front face of the drive plate 100P engage the flange of the bezel only along small surfaces provided by slide ribs 120 (FIG. 11).

The push button 100P requires no description beyond mentioning that is has a keel 144 that receives the upper end of the spring 200.

The lock mechanism is assembled by inserting the lock rods into the guideways of the base from the distal ends, inserting the drive plate from the front onto the cam follower posts and pressing it home on the snap-fit vertical guide rib, and installing the spring.

The spring normally maintains the lock mechanism in the locked position. When the push button is depressed, the driver plate spring is compressed, thus unloading the biasing force from the lock rods. When the push bottom driver begins to move down, the static friction forces acting between the lock rods and the base are overcome by an axial force component between the elliptical cam slots and the cam follower posts that is relatively large, because of the steeper slopes of the end portions of the slots. The ratio of axial to side forces at the cam slot/cam post interface is highest at the moment of initial movement of the lock rods when static friction is present. Also, the spring force does not act at the cam slot/cam post interface when the mechanism is operating in the unlocking mode. Unlocking is smooth and easy, with a relatively low side load component and no spring forces acting on the lock rods. The careful design of the supporting surfaces with small areas for low friction also contribute very significantly to smooth and reliable release.

When the mechanism is at rest in the release position as the towing handle is moving to the new position, the axial/side ratio of the force at the cam/follower interface is favorable to snapping the lock pins into the holes in the handle by the force of the spring. Low friction between the driver and the surfaces that guide it make the spring force available primarily for driving the lock rods.

What is claimed is:

1. A releasable lock mechanism for a luggage towing handle that is movable relative to a bag body between an extended position and a retracted position, the towing handle having a pair of spaced-apart parallel straight legs, comprising a base adapted to be affixed to the bag body in a position between the legs of the handle and having a pair of guideways defining a slide axis perpendicular to and intersecting the legs;

a lock rod received in each of the guideways for sliding movement along the slide axis between a locked position in which a nose on a distal end of the lock rod is extended out from the base for reception in a hole in the respective leg of the towing handle and a release position in which the nose is retracted from the hole in the leg, each lock rod having a cam follower post adjacent a proximal end;

a push-button driver plate carried on the base for movement perpendicular to the axis and having a pair of elongated cam slots, each of the cam slots in the driver plate being substantially elliptical and each cam slot receiving the cam follower post of one of the lock rods and having a longer axis lying obliquely to the slide axis; and a compression spring engaged between the base and the driver plate and biasing the driver plate to a position in which the cam slots hold the lock rods in the locked positions.

2. A releasable lock mechanism according to claim 1 wherein the cam slots are intersected by the slide axis.

3. A releasable lock mechanism according to claim 1 wherein the cam follower posts have circular cylindrical surfaces.

4. A releasable lock mechanism according to claim 1 wherein each of the guideways is channel-shaped and includes a bottom wall and each lock rod has a longitudinal bottom rib in sliding engagement with the bottom wall.

5. A releasable lock mechanism according to claim 4 wherein each guideway has a guide bridge and each lock rod has a longitudinal top rib in sliding engagement with the bridge.

6. A releasable lock mechanism according to claim 5 wherein each lock rod has an offset leg portion, the cam follower post extends from the offset leg portion, and the back wall of the base has a projecting rib having an undersurface in sliding engagement with an upper edge of the offset leg portion of each lock rod.

7. A releasable lock mechanism according to claim 6 wherein the driver plate has a slide rib in engagement with a front face of the offset leg portion.

8. A releasable lock mechanism according to claim 1 wherein each of the guideways is channel-shaped and includes a bottom wall, a front wall, a rear wall, and a guide bridge spaced apart from the bottom wall and joined to the front and back walls, and each lock rod has a longitudinal bottom rib in sliding engagement with the bottom wall and a longitudinal top rib in sliding engagement with and undersurface of the bridge.

9. A releasable lock mechanism according to claim 8 wherein each lock rod has a peripheral guide rib adjacent the nose that is in sliding engagement with the bottom wall, front wall, and back wall of the guideway of the base.

10. A releasable lock mechanism according to claim 8 wherein each lock rod has an offset leg portion, the cam follower post extends from the offset leg portion, and the back wall of the base has a projecting rib in sliding engagement with an upper edge of the offset leg portion of each lock rod.

11. A releasable lock mechanism according to claim 1 wherein the base has a back wall having a driver plate guide rib, and the driver plate has a groove receiving the guide rib for sliding movement.

12. A releasable lock mechanism according to claim 11 wherein the driver plate guide rib and the driver plate groove are coupled by a snap-fit coupling.

13. A releasable lock mechanism for a luggage towing handle that is movable relative to a bag body between an extended position and a retracted position, the towing handle having a pair of spaced-apart parallel straight legs, comprising a base adapted to be affixed to the bag body in a position between the legs of the handle and having a pair of guideways defining a slide axis perpendicular to and intersecting the legs, each of the guideways being channel-shaped and including a bottom wall, a front wall, a rear wall, and a guide bridge spaced apart from the bottom wall and joined to the front and back walls;

a lock rod received in each of the guideways for sliding movement along the slide axis between a locked position in which a nose on a distal end of the lock rod is extended out from the base for reception in a hole in the respectiveleg of the towing handle and a release position in which the nose is retracted from the hole in the respective leg of the towing handle, each lock rod having a longitudinal bottom rib in sliding engagement with the bottom wall of the respective guideway and a longitudinal top rib in sliding engagement with the bridge of the guideway and each lock rod having a cam follower post adjacent a proximal end;

a push-button driver plate carried on the base for movement perpendicular to the axis and having a pair of elongated cam slots, each cam slot being substantially elliptical, being intersected by the slide axis, and receiving the cam follower post of one of the lock rods; and a compression spring engaged between the base and the driver plate and biasing the driver plate to a position in which the cam slots hold the lock rods in the locked positions.

14. A releasable lock mechanism according to claim 13 wherein each lock rod has a peripheral guide rib adjacent the nose that is in sliding engagement with the bottom wall, front wall, and back wall of the guideway of the base.

15. A releasable lock mechanism according to claim 14 wherein each lock rod has an offset leg portion, the cam follower post extends from the offset leg portion, and the back wall of the base has a projecting rib in sliding engagement with an upper edge of the offset leg portion of each lock rod.

16. A releasable lock mechanism according to claim 13 wherein the base has a back wall having a driver plate guide rib, the driver plate has a groove receiving the guide rib for sliding movement.

17. A releasable lock mechanism according to claim 16 wherein the driver plate guide rib and the driver plate groove are coupled by a snap-fit coupling.

18. A releasable lock mechanism for a luggage towing handle that is movable relative to a bag body between an extended position and a retracted position, the towing handle having a pair of spaced-apart parallel straight legs, comprising a base adapted to be affixed to the bag body in a position between the legs of the handle and having a pair of guideways defining a slide axis perpendicular to and intersecting the legs, each of the guideways being channel-shaped and including a bottom wall and a guide bridge;

a lock rod received in each of the guideways for sliding movement along the slide axis between a locked position in which a nose on a distal end of the lock rod is extended out from the base for reception in a hole in the respective leg of the towing handle and a release position in which the nose is retracted from the hole in the respective leg of the towing handle, each lock rod having a longitudinal bottom rib in sliding engagement with the bottom wall of the respective guideway, a longitudinal top rib in sliding engagement with the bridge of the respective guideway, and a cam follower post adjacent a proximal end;

a push-button driver plate carried on the base for movement perpendicular to the axis and having a pair of elongated cam slots, each cam slot receiving the cam follower post of one of the lock rods and having a longer axis lying obliquely to the slide axis; and a compression spring engaged between the base and the driver plate and biasing the driver plate to a position in which the cam slots hold the lock rods in the locked positions.

19. A releasable lock mechanism according to claim 18 wherein each of the cam slots in the driver plate is substantially elliptical.

20. A releasable lock mechanism according to claim 18 wherein the cam slots are intersected by the slide axis.

* * * * *